United States Patent [19]

Mills

[11] Patent Number: 4,480,576

[45] Date of Patent: Nov. 6, 1984

[54] BOAT MOORING APPARATUS

[76] Inventor: Robert J. Mills, 5327 Osceola Ct., Brooksville, Fla. 33526

[21] Appl. No.: 468,390

[22] Filed: Feb. 22, 1983

[51] Int. Cl.[3] ..... B63B 21/00

[52] U.S. Cl. ..... 114/230

[58] Field of Search ..... 114/230; 248/163.1, 248/163.5

[56] References Cited

U.S. PATENT DOCUMENTS

| | | | |
|---|---|---|---|
| 3,722,881 | 3/1973 | Vilotti | 248/163.1 |
| 3,763,816 | 10/1973 | Wilson, Jr. | 114/230 |
| 3,842,779 | 10/1974 | Jaynes | 114/230 |

*Primary Examiner*—Sherman D. Basinger

*Attorney, Agent, or Firm*—Orrin M. Haugen; Thomas J. Nikolai; Douglas L. Tschida

[57] ABSTRACT

A boat mooring arrangement which permits the boat to rise and drop vertically with tides or wave action, but which constrains the boat from lateral movement relative to a fixed dock or pier. A pair of cylindrical posts are affixed to the dock or pier at spaced-apart locations and extend vertically downward therefrom for a predetermined distance below the surface of the water. Associated with each of these posts is a carriage assembly comprising a U-shaped collar having rollers journaled for rotation across the spaced-apart legs of the U-shaped collar. The carriage assemblies cooperate with the exterior surface of the posts and ride up and down with respect to the posts when the carriage assemblies are fastened to the boat to be moored by suitable tie lines and changes in water level are encountered.

5 Claims, 3 Drawing Figures

BOAT MOORING APPARATUS

BACKGROUND OF THE INVENTION

1. Field of the Invention

This invention relates generally to boat mooring apparatus, and more specifically to apparatus for securing a boat to a fixed dock or pier in such a fashion that it is free to move vertically with changes in tide or with wave action.

2. Discussion of the Prior Art

As is explained in the Jarnot U.S. Pat. No. 2,808,016, in areas having significant tide differentials, a problem arises in mooring a boat to a dock or a pier in that it is necessary to leave the lines sufficiently slack to permit rise and fall of the boat with the tide and yet have the line tight enough to anchor the boat sufficiently to prevent accidental engagement with other moored boats or the like. Similarly, when a boat is loosely moored, wave action may repeatedly bounce the boat against the dock or pier resulting in possible damage to the craft and dock. In accordance with the teachings of the Jarnot patent, a hollowed, cylindrical, tubular post is affixed to the pier in a vertical orientation and a slot is formed through the side wall of the tube. Contained within the tube is a float having a tiepoint wall of the tube. Contained within the tube is a float having a tiepoint extending through the slot to which a mooring line may be attached. As the tide rises and falls, so does the float, thus maintaining the same relative orientation between the tie point and the boat being moored.

The boat mooring arrangement reflected in the Jarnot patent suffers certain deficiencies especially following some period of use. In that the interior of the tubular guide is exposed to the water and marine life, but is not particularly subject to the cleansing action of waves, the interior walls of the tube, after a short time, become encrusted with marine life and other debris which interfers with the ability of the float to move up and down within the confines of the tube in which it is disposed. As such, the float is subjected to undue wear and is ultimately destroyed.

SUMMARY OF THE INVENTION

In accordance with the present invention, the boat mooring system for use in tidewater areas comprises a pair of spaced-apart support braces which are fixedly secured to a dock or pier. Attached to the braces and projecting vertically downward into the water for a predetermined distance are cylindrical posts. Cooperating with each of the spaced-apart vertical posts is a carriage arrangement comprising a generally U-shaped bracket or collar having roller members extending across the open end of the U and arranged to ride up and down along the outer surfaces of the cylindrical posts. Mooring lines are used to couple the boat to the movable carriage members. Thus, as the tide rises and falls, the boat is free to move upward and downward, while still being held in its lateral position relative to the vertical, spaced-apart posts. In that the carriage member and its associated roller cooperates with the exterior surface of the posts, and because that exterior surface is less prone to the buildup of marine life or other debris, the mooring arrangement of the present invention offers a distinct advantage over the prior art as represented by the above-referenced Jarnot patent.

It is accordingly a principal object of the present invention to provide a new and improved boat mooring arrangement.

Another object of the invention is to provide, as an attachment to a dock or pier, a boat mooring apparatus which permits the craft so moored to rise and fall with the tide or with wave action.

A still further object of the invention is to provide a boat mooring attachment for a dock or pier which permits vertical movement of the moored craft without attendant lateral shifting thereof.

A still further object of the invention is to provide a boat mooring attachment for a dock or pier which is rugged and long wearing and inexpensive to manufacture and install.

These and other objects and advantages of the invention will become apparent to those skilled in the art from the following detailed description of a preferred embodiment when considered in conjunction with the accompanying drawings in which like numerals in the several views refer to corresponding parts.

DESCRIPTION OF THE PREFERRED EMBODIMENT

Figure 1:
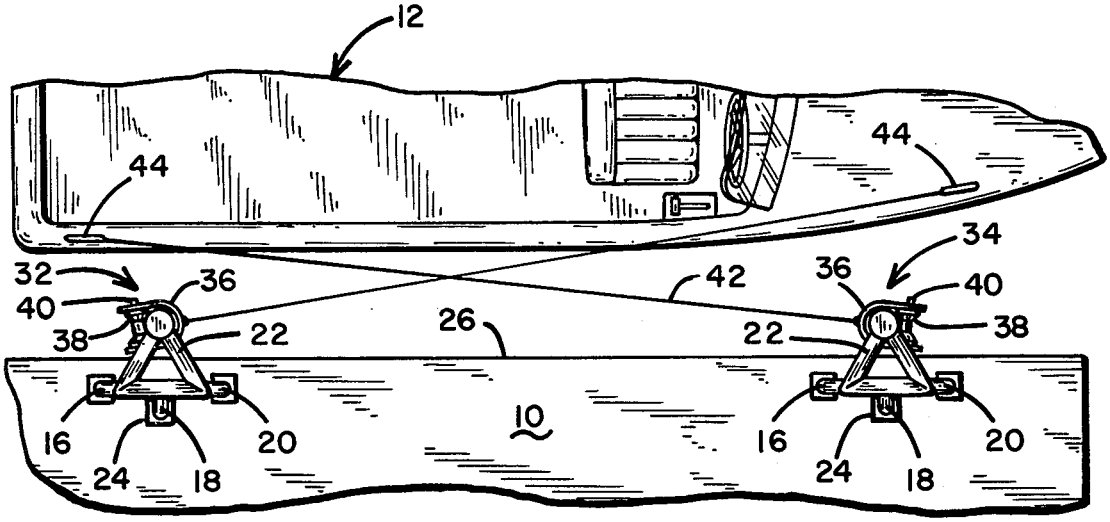
FIG. 1 is a top plan view of the boat mooring apparatus of this invention.
Figure 2:
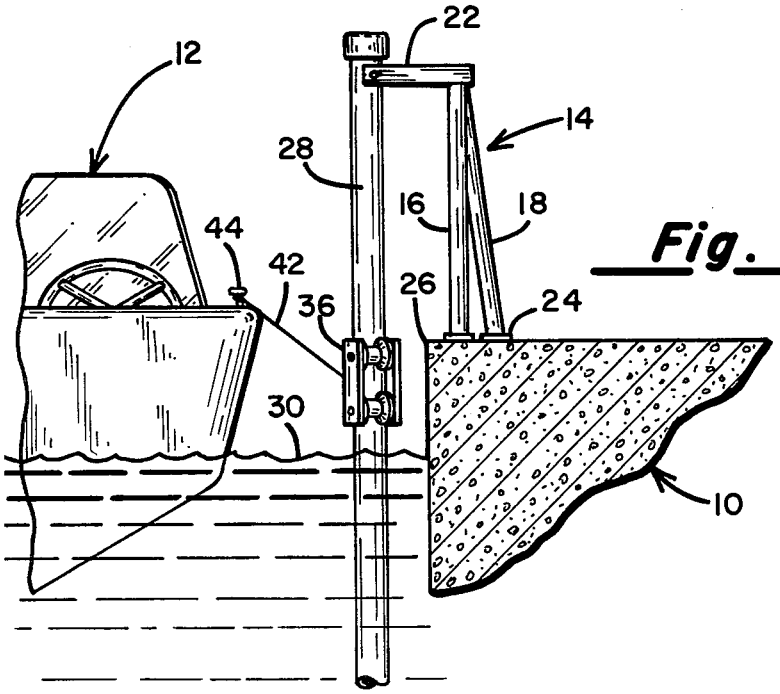
FIG. 2 is a side elevation view of the preferred embodiment.
Figure 3:
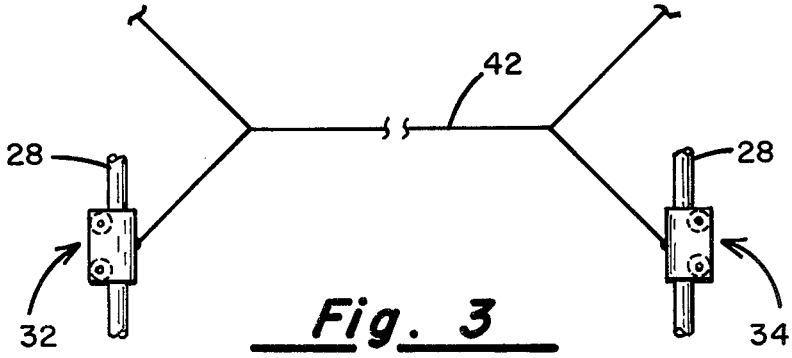
FIG. 3 illustrates the manner in which mooring lines may be connected to the boat to be moored and to the movable carriage assemblies of the preferred embodiment.

Referring to FIGS. 1 and 2, numeral 10 identifies a dock, pier or like object to which a boat 12 is to be secured. Attached to the horizontal surface of the dock 10 is an upwardly extending tripod assembly 14 having support legs 16, 18 and 20 joined to a generally triangular support brace 22. Depending upon the type of construction for the pier or dock 10, the tripod legs 16–20 may be attached thereto by various means such as lag bolts (not shown) passing through mounting plates 24 which are welded or otherwise secured to the bottom of each leg. The legs are preferably about three feet in length, but limitation to such length is not to be inferred.

As can be seen from FIG. 2, the support brace 22 on each of the spaced-apart tripod assemblies 14 has a cantelevered portion which projects beyond the edge 26 of the dock 10 and pivotally secured thereto is a downwardly extending cylindrical pipe or post 28. The pipe 28 is of a predetermined length so as to extend below the waterline 30 at low tide conditions.

With no limitation intended, the pipe 28 is preferably formed from a three-inch diameter extruded polyvinyl chloride plastic which is available through plumbing supply houses. The support brace 22 and the tripod legs 16–20 may be formed from plastic, aluminum or other suitable material is not prone to deterioration under environmental conditions existing at dockside.

Cooperating with the posts 28 are carriage assemblies 32 and 34. The carriage assemblies each comprise a generally U-shaped collar 36, which is dimensioned to surround the outside surface of the posts 28, and extending transversely between the opposed legs of the U-shaped collar is a roller member 38 which is journaled for rotation of an axel 40 passing through the edge portions of the legs of the collar 36. The roller 38 may be formed of a hard rubber, a plastic or other suitable material and is contoured to accommodate the circular Profile of the posts 28.

Affixed to the closed, curved end portion of the collar 36 of each of the carriages is a mooring line 42 which is also adapted to be secured to appropriate tie points on the boat 12, such as at cleats 44.

As the water level 30 rises and falls, the collar 36 likewise will move up and down relative to the pipe 28 with the rollers 38 riding against the exterior surface of the pipe. In that the pipe 28 is pivotally secured at its upper end to the support braces 22, the pipe is free to swing only slightly back and forth like a pendulum so as to allow limited motion which might be caused by wind or waves.

The invention has been described herein in considerable detail, in order to comply with the Patent Statutes and to provide those skilled in the art with the information needed to apply the novel principles, and to construct and use such specialized components as are required. However, it is to be understood that the invention can be carried out by specifically different equipment and devices, and that various modifications, both as to equipment details and operating procuedures, can be effected without departing from the scope of the invention itself.

What is claimed is:

1. Boat mooring apparatus allowing vertical movement of the moored boat comprising:

(a) at least two elongated cylindrical posts;

(b) vertically upward extending tripod means for each cylindrical post for attaching said post in a vertical disposition at predetermined spaced-apart locations along the edge of a dock or pier with one end of the post extending a predetermined distance below the water's surface;

(c) said tripod means including legs fastened to a horizontal surface of said dock or pier along an edge thereof adjacent to the location where the boat is to be moored, bracket means and means to pivotally connect the post to the tripod;

(d) a first and a second carriage, one for each cylindrical post each having roller means slidably cooperating with the exterior surface of a respective one of said posts for vertical motion therealong; and (e) tie lines joining each of said carriage assemblies to the boat being moored, said tie lines limiting lateral movement of said boat relative to said dock or pier.

2. The boat mooring apparatus as in claim 1 wherein said first and second carriage assemblies each include:

(a) generally U-shaped collar member having said roller means journaled for rotation between opposed legs of said U-shaped collar member with said collar member surrounding said posts.

3. The boat mooring apparatus as in claim 2 wherein said tie lines join at one end to said collar members, with the other end adapted to join to a cleat on said moored boat.

4. The boat mooring apparatus as in claim 1 wherein said posts are formed from a non-corroding and non-rotting material.

5. The boat mooring apparatus as in claim 4 wherein said material is extruded polyvinyl chloride tubing.

* * * * *

UNITED STATES PATENT AND TRADEMARK OFFICE

CERTIFICATE OF CORRECTION

PATENT NO. : 4,480,576

DATED : November 6, 1984

INVENTOR(S) : Robert J. Mills

It is certified that error appears in the above-identified patent and that said Letters Patent are hereby corrected as shown below:

Column 4, Line 10, after the word "carriage" the word -- assembly -- should be inserted.

Column 4, Line 11, after the word "post" a comma -- , -- should be inserted.

Signed and Sealed this

*Nineteenth* Day of *March 1985*

[SEAL]

*Attest:*

DONALD J. QUIGG

*Attesting Officer*

*Acting Commissioner of Patents and Trademarks*